US006135442A

United States Patent [19]

Hirata et al.

[11] Patent Number: 6,135,442

[45] Date of Patent: Oct. 24, 2000

[54] ELECTRONIC PRINTING APPARATUS, PAPER SEPARATING UNIT

[75] Inventors: Koji Hirata; Kiyoshi Nakamichi, both of Hyogo, Japan

[73] Assignee: Fujitsu Limited, Kawasaki, Japan

[21] Appl. No.: 09/030,358

[22] Filed: Feb. 25, 1998

[30] Foreign Application Priority Data

Aug. 28, 1997 [JP] Japan ..... 9-232210

[51] Int. Cl.[7] ..... B65H 3/06

[52] U.S. Cl. ..... 271/116; 271/121; 271/125; 271/110; 271/10.3

[58] Field of Search ..... 271/116, 121, 271/125, 110, 10.13

[56] References Cited

U.S. PATENT DOCUMENTS

| | | | |
|---|---|---|---|
| 4,030,722 | 6/1977 | Irvine et al. | 271/10.13 |
| 4,083,555 | 4/1978 | Irvine et al. | 271/10.13 |
| 4,248,415 | 2/1981 | Steinhilber | 271/10.13 X |
| 5,029,837 | 7/1991 | Uchiyama | 271/110 |
| 5,265,857 | 11/1993 | Chiang | 271/10.13 |
| 5,462,267 | 10/1995 | Hori | 271/116 X |
| 5,474,287 | 12/1995 | Takahashi | 271/116 X |
| 5,571,265 | 11/1996 | Yagi et al. | 271/116 X |
| 5,860,645 | 1/1999 | Tomura et al. | 271/10.13 |

FOREIGN PATENT DOCUMENTS

| | | |
|---|---|---|
| 6-171783 | 6/1994 | Japan . |
| 7-206198 | 8/1995 | Japan . |

*Primary Examiner*—Christopher P. Ellis
*Assistant Examiner*—Richard Ridley
*Attorney, Agent, or Firm*—Armstrong, Westerman, Hattori, McLeland & Naughton

[57] ABSTRACT

A paper separating unit and an electronic printing apparatus which includes said paper separating unit wherein paper is picked by a pick roller from a paper container, is fed into a gap between a first feed roller and a separate roller which are rotating in the same rotational direction, then the first sheet of paper is separated from the other and is fed to a second feed roller, and when the first paper is acceleratedly fed, and a motor which drives the first feed roller and the separate roller is stopped, a one-way clutch which prevents a separate roller from reverse-rotating together with the paper conveyed by the second feed roller so that feeding more than one sheet of paper can be firmly prevented.

6 Claims, 8 Drawing Sheets

ELECTRONIC PRINTING APPARATUS, PAPER SEPARATING UNIT

BACKGROUND OF THE INVENTION

The present invention relates to a paper separating unit to firmly prevent from more than one sheet of paper from being fed at a time, and an electronic printing apparatus which has the paper separating unit.

FIG. 1 is a perspective view of a paper feeding unit disposed in an electrophotographic device manufactured by FUMITSU LIMITED.

As shown in the perspective view of FIG. 1, this paper feeding unit is to prevent more than one sheet of paper P from being fed at a time (it is referred to as a multiple-feeding for later description in this specification), using a separate roller 3, as it picks up the paper P from a paper container where the paper is contained by a pick roller 1, then feeds the paper into a gap between a first feed roller 2 and the separate roller 3.

Therefore, the pick roller 1 and the first feed roller 2 are driven by a motor 4 in the same rotational direction in the present specification, rotational direction means the direction of angular displacement, not a tangential direction, (here the direction rotational such is that the lower perimeter of the pick roller 1 and the first feed roller 2 rotate from the pick roller 1 side to the first feed roller 2 side, i.e., clockwise on FIG. 1). On the other hand, while being pressed onto the first feed roller 2 with a predetermined magnitude of force, the separate roller 3 is driven by said motor 4, in the same direction as that of the first feed roller 2.

A torque limiter 5 is placed between this motor 4 and the separate roller 3, and when more than one sheet of the paper P attempt to pass through the gap between the first feed roller 2 and the separate roller 3, a rotational force generated by the separate roller 3 is applied on the second and lower sheets of paper P, and it generates a slip between the first paper P and the second paper P, then separates them apart, only the first sheet of paper P is pushed out from between the first feed roller 2 and the separate roller 3. However if only one sheet of paper P is fed into the gap between the first feed roller 2 and the separate roller 3, the separate roller 3 would be driven by the first feed roller 2 through this paper P without disturbing feeding of the paper P while it rotates in the opposite rotational direction as that of the first feed roller 2.

As the paper P which has passed through the gap between the first feed roller 2 and the separate roller 3 is fed to a second feed roller 6, the second feed roller 6 is driven to acceleratedly fed the paper P while rotation of said motor 4 in the first rotational direction is stopped.

Each of two one-way clutches 7, 8 is interposed between the first feed roller 2 and the motor 4 which drives the first feed roller 2, and between the pick roller 1 and the motor 4 respectively. After the motor 4 is stopped, the first feed roller 2 and the pick roller 1 are driven by the paper P which is acceleratedly fed by the second feed roller 6 in the paper feeding direction.

On the other hand, at the separate roller 3, friction is caused and it stops the separate roller 3 when the motor 4 is attempted to be rotated so that it gives a resisting force to the paper P, preventing the multiple-feeding.

However, it might happen that when the second feed roller 6 described above is driven, and, the paper P passing through the gap, the first feed roller 2 and the separate roller 3 is strongly pulled in its feeding direction, the motor 4 is driven via the separate roller 3 to rotate in the reverse rotational direction (the rotational direction opposite to the first rotational direction, i.e., counterclockwise on FIG. 1) by this paper P which is acceleratedly fed. In this case, since the first feed roller 2 and the pick roller 1 freely rotate in the paper feeding direction from the motor 4 due to the one-way clutches 7, 8, the multiple-feeding can occur as more than one sheet of paper P are fed into the gap between the first feed roller 2 and the separate roller 3.

Besides, to improve the capability of the paper separating, it is effective to increase a predetermined torque of the torque limiter 5; however, the higher the predetermined torque of the torque limiter 5 is set, the higher the probability of the reverse-rotation of the motor 4 becomes which moves along with the separate roller 3 when the second feed roller 6 accelerates feeding of the paper P.

As a method to prevent the reverse-rotation of the motor 4 as above, a method may be arise wherein the first feed roller 2 and the separate roller 3 are continuously driven without the accelerated feeding by the second feed roller 6 until the back end of the paper P passes through the gap between the first feed roller 2 and the separate roller 3.

However, in order to increase the operational speed of the apparatus, this method cannot be taken since it is advantageous to acceleratedly feed the paper P immediately after the front end of the paper P passes through the gap between the first feed roller 2 and the separate roller 3, when feeding the paper P out of the paper container which is located far from a printing portion, especially where the paper container is made multi-tiered.

As another method to prevent the multiple-feeding, a method may be arise wherein the rotational speed of the pick roller 1, the first feed roller 2, and the separate roller 3 is increased while accelerating the feeding of the paper P.

However this method cannot be taken either, since it inevitably causes enlargement of the drive system which drives those rollers and complication of their control devices, thus it cannot avoid a cost increase as a result.

Moreover, as a method other than described above to prevent the multiple-feeding, a method may be arise wherein i.e., fixing the separate roller 3 without driving it as disclosed in the Japanese Patent Application Laid-Open No. 6-171783 (1994). However, this method is not favorable since it causes a large friction on the paper P, and it has problems that it often allows several sheets of paper P to be completely overlapped when separating of the paper P has failed.

BRIEF SUMMARY OF THE INVENTION

The present invention has been made with the aim of solving the above problems, and it is one object of the present invention to provide a paper separating unit which prevents the multiple-feeding of paper P, and an electronic printing apparatus which carries said paper separating unit.

The paper separating unit of the present invention which comprises a pick roller for picking paper from a paper container; a first feed roller for feeding said paper picked by said pick roller in order, said first feed roller being driven in a first rotational direction; a separate roller being pressed onto said first feed roller; a motor for driving said separate roller in the same rotational direction as that of said first feed roller; a drive system interlocking said separate roller with said motor; a torque limiter being interposed in said drive system; and a second feed roller for acceleratedly feeding paper which has passed through the gap between the first feed roller and the separate roller, is characterized in including a reverse-rotation preventing portion for preventing said separate roller from rotating in a second rotational direction which is opposed to that of said first feed roller when said motor is stopped, i.e., when rotation of said motor in the first rotational direction is stopped, so that said separate roller does not rotate together with said paper which is accelerated fed by said second feed roller.

The electronic printing apparatus of the present invention is characterized in comprising said paper separating unit, and further comprising a paper container for containing said paper, and a printing portion for printing on said paper acceleratedly fed by said second feed roller.

Therefore, by comprising said reverse-rotation preventing portion which prevents reverse-rotation of the separate roller which interlocking the paper fed by the second feed roller when the motor stopped, the electronic printing apparatus acts as follows:

When more than one sheet of the paper are picked up from the paper container, and fed into the gap between the first feed roller and the separate roller, only the top paper is allowed to be fed in its feeding direction by the first feed roller, while the remaining sheets of paper underneath the top paper are fed back in the opposite direction of its feeding.

While only the top paper is fed forward in the feeding direction, then its feeding rate is increased by the second feed roller when the motor is stopped. However, since the reverse-rotation preventing portion prevents the separate roller from being driven in the reverse rotational direction by the paper acceleratedly fed, the paper is acceleratedly fed without interference of the separate roller and the first feed roller, at the same time, the remaining of paper once fed back into the paper container can not be re-fed into the gap between the first feed roller and the separate roller and to the second feed roller.

It is another object of the present invention to provide a concrete composition of said reverse-rotation preventing portion.

The reverse-rotation preventing portion is characterized in being a one-way clutch being interposed between the motor and the separate roller.

Therefore, the reverse-rotation of the separate roller is prevented by providing the one-way clutch which maintains the rotation of the separate roller while it is driven by the motor and races the separate roller when it is driven by the first feed roller.

The reverse-rotation preventing portion is characterized in that it includes a worm gear interlocked with said motor, and a gear interlocked with said separate roller and mating with said worm gear.

Therefore, since there is a directivity in the transmission of driving force between the worm gear and said gear so that it is impossible to transmit the driving force to the worm gear by rotating said mating gear, the reverse-rotation of the separate roller interlocked with the gear is prevented.

The reverse-rotation preventing portion is characterized in that it includes a ratchet gear connected with an arbitrary rotational axis of said drive system wherein the motor and the separate roller is interlocked, and a pawl engaging said ratchet gear.

Therefore, since the above constitution has a directivity of driving force similar to the combination of the worm gear and the mating gear described above so that it is impossible to transmit the driving force to the ratchet gear by driving the pawl, the reverse-rotation of the separate roller interlocked with the ratchet gear can be prevented.

The reverse-rotation preventing portion is characterized in that it includes a current applying portion for applying holding current to the motor to stop said motor, not for mechanically preventing the reverse-rotation of said separate roller as described above.

Moreover, said reverse-rotation preventing portion is characterized in that it is a motor control portion supplying a sufficient amount of current to stop said motor as described above.

Therefore, where the separate roller interlocked with the motor is driven in the reverse direction by the paper, the reverse-rotation of the separate roller is prevented by applying current to the motor to generate the same magnitude of force as that of the driving force.

The electronic printing apparatus and the paper separating unit disposed in the electronic printing apparatus of this invention are not to limit their application to the electrophotographic device described above and they are applicable to a device which includes a paper feeding unit, such as a facsimile, a scanner, a printer, and so forth.

The above and further objects and features of the invention will more fully be apparent from the following detailed description with accompanying drawings.

BRIEF DESCRIPTION OF THE SEVERAL VIEW OF THE DRAWINGS

DETAILED DESCRIPTION OF THE INVENTION

The following is a description of the present invention in details with reference to the drawings showing embodiments of the present invention.

Figure 1:
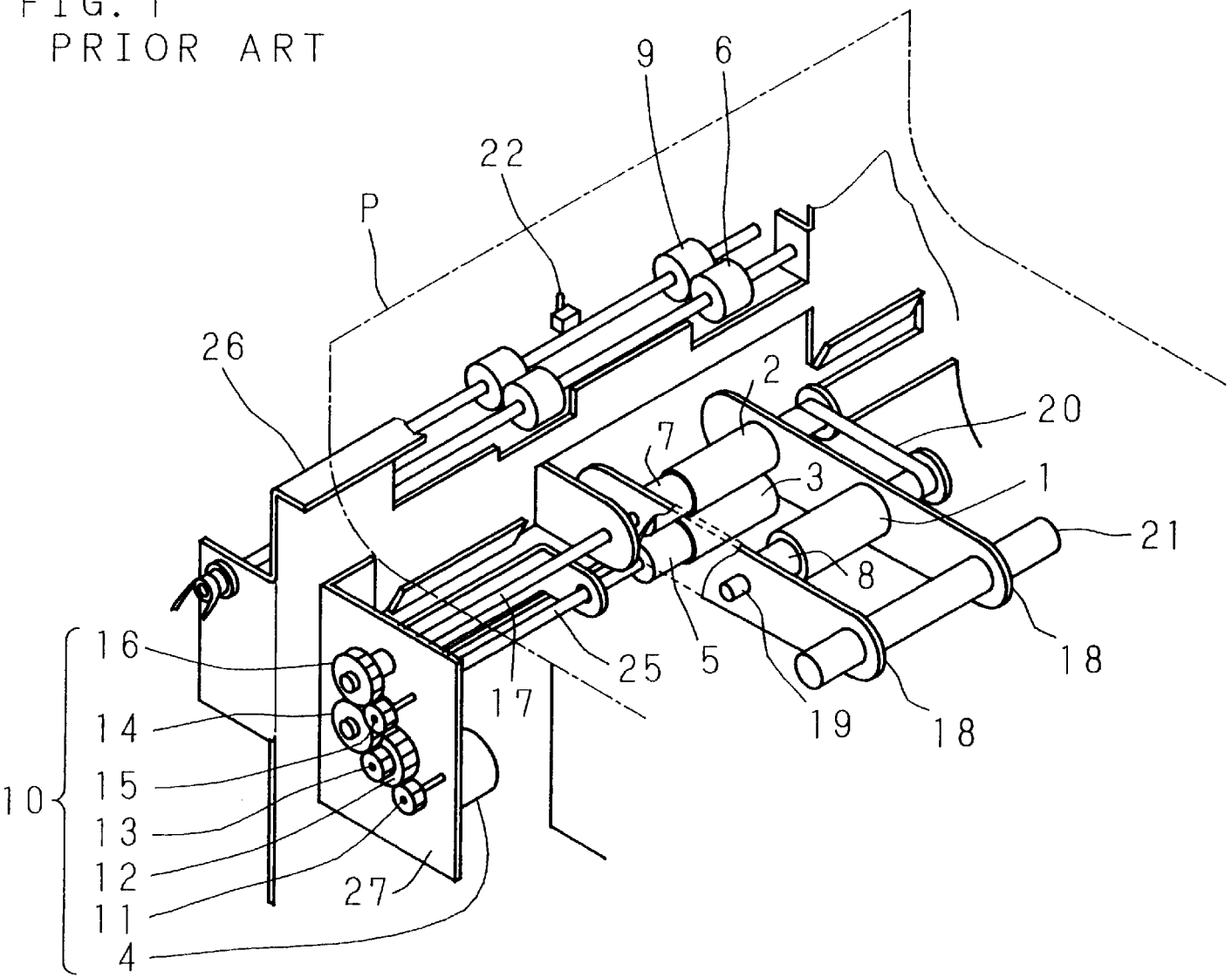
FIG. 1 PRIOR ART
FIG. 1 is a perspective view showing the paper feeding unit of a conventional electrophotographic device.
Figure 2:
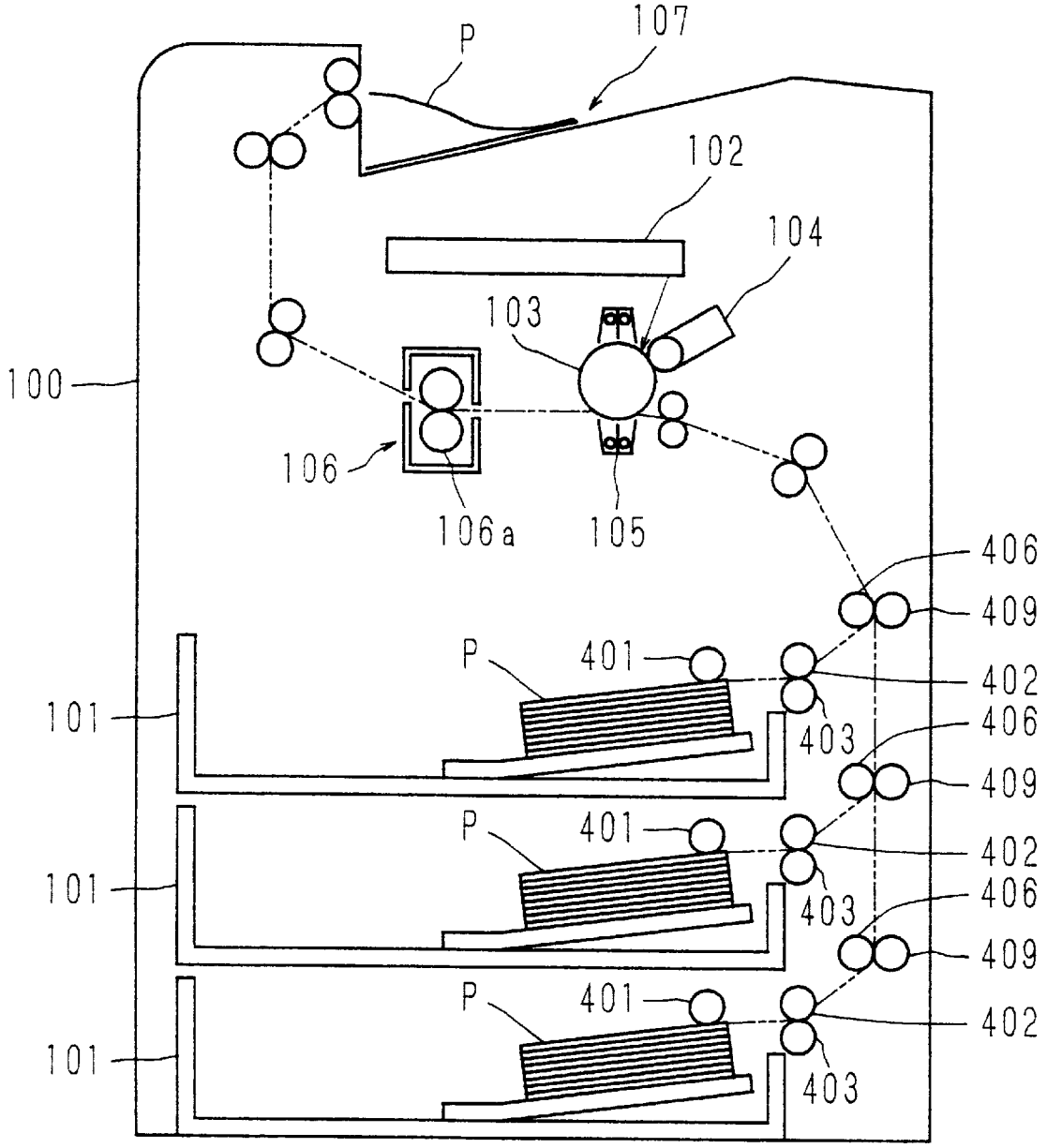
FIG. 2 is a sectional side elevation view showing an electrophotographic device of the present invention.

FIG. 2 is a sectional side elevation view showing an electrophotographic device of the present invention. In FIG. 2, the electrophotographic device of the present invention comprises, three paper containers 101 disposed within the lower portion of an outer case 100 wherein the paper containers 101 are stacked as made multi-tiered drawers for containing paper P, an optical unit 102 disposed within the outer case 100, a photosensitive drum 103 for forming an electrostatic latent image through electrophotographic processing by exposing with the optical unit 102, a developing unit 104 for developing a toner image by bonding toner on the electrostatic latent image, a transferring unit 105 for transferring the toner image onto a paper P which has been conveyed from any of the paper containers 101, a fixing device 106 for fixing toner sticking on the surface of paper P onto the paper P by thermal fusing, a discharged paper stacker 107 disposed on the top portion of the outer case 100 and for stacking toner fixed paper P.

Paper P which has been picked out from the paper container 101 and conveyed, is supplied to the photosensitive drum 103 and transferred a toner image formed on the side face of the photosensitive drum 103 by transferring unit 105, then engaged with heat rollers 106*a* disposed within the fixing device 106, fixed the transferred image by thermal fusing, and discharged to the discharged paper stacker 107.

Figure 3:
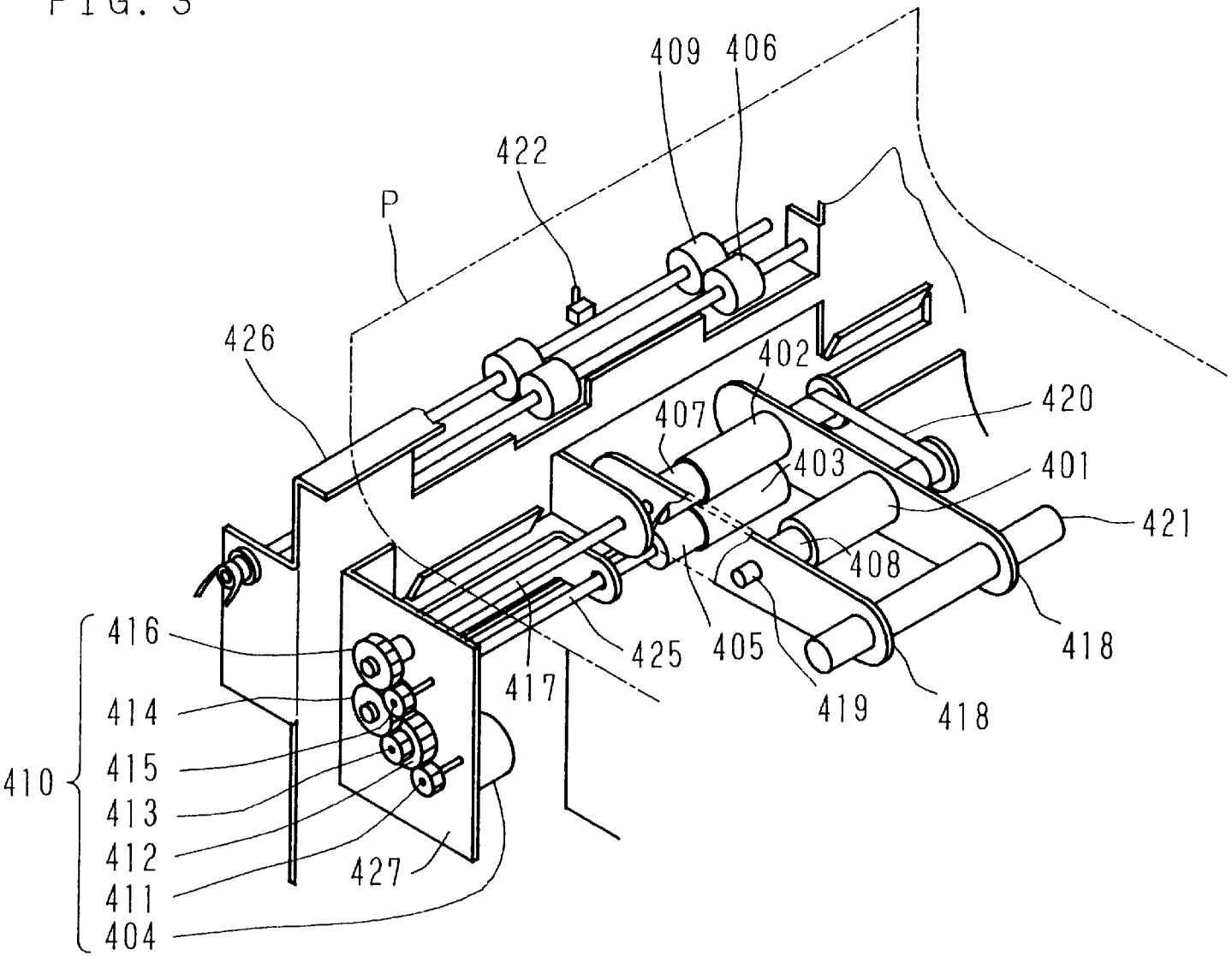
FIG. 3 is a perspective view showing a paper feeding unit of the electrophotographic device of the present invention.

FIG. 3 is a perspective view showing a key portion of a paper feeding unit of the electrophotographic device where one embodiment of the present invention is applied. This electrophotographic device has a pick roller 401 for picking paper P from a paper container 101, a first feed roller 402 for feeding the paper P picked by the pick roller 401, and a separate roller 403 which is pressed on this first feed roller 402 with a predetermined magnitude of force.

These rollers, the pick roller 401, the first feed roller 402, and the separate roller 403, re to be driven by a common motor 404 in the same first rotational direction.

A drive system 410 interlocked with these rollers, the pick roller 401, the first feed roller 402, and the separate roller 403, and the motor 404, comprises an output-axis gear 411 fixed on the output axis of the motor 404, a first idler gear 412 mated with that gear, a second idler gear 413 fixed coaxially to the first idler gear 412, a separate-roller driving gear 414 mated with the second idler gear 413, a third idler gear 415 mated with the separate-roller driving gear 414, and a feed-roller driving gear 416 mated with the third idler gear 415.

The feed-roller driving gear 416 is fixed at one end of a first rotational axis 417 which coaxially holds the first feed roller 402, and the first rotational axis 417 and the first feed roller 402 are connected to be interlocked by a one-way clutch 407.

A pick roller 401 is supported on this first rotational axis 417 through arms 418 and a first fixed axis 419 fixed to these arms 418, and another one-way clutch is interposed between the first fixed axis 419 and the pick roller 401, while the pick roller 401 and the first feed roller 402 are connected to be interlocked by a belt drive unit 420.

The pick roller 401 is pressed down on the top paper P in the paper container 101 by weight of the arms 418, a bob 421 supported at each tip of the arms 418, the pick roller 401, the belt drive unit 420, and so forth, and picks up this paper P out of the paper container 101 as the motor 404 is started.

When the paper P is picked from the paper container 101 to be fed into a gap between the first feed roller 402 and the separate roller 403, it might happen that the second and lower sheets of paper P are fed out overlapped each other from the paper container 101.

In this case, the top paper P is fed in the feeding direction by the first feed roller 402 and the second and lower sheets of paper P are fed back in the direction opposite to the feeding direction. This back-feeding is made possible by a slip generated between the top paper P and the second paper P. On the other hand, when only one paper P is fed into the gap between the first feed roller 402 and the separate roller 403, a rotational force of the first feed roller 402 acts on the separate roller 403 through this paper P, a torque limiter 405 acts to cut off the driving force from the motor 404 to the separate roller 403, and then the separate roller 403 rotates in the reverse rotational direction which is opposed to the first rotational direction, so that the separate roller 403 rotates along with the paper P.

As a result, the only one paper P is fed out from the gap between the first feed roller 402 and the separate roller 403, this paper P is fed into a gap between the second feed roller 406 and a pinch roller 409 pressed onto the second feed roller with the predetermined magnitude of force.

When the front end of the paper P fed into the gap between the second feed roller 406 and the pinch roller 409 is detected by a paper sensor 422, the second motor not illustrated is started, then accelerated feeding of the paper P is started by the second feed roller 406, while the motor 404 is stopped, i.e., rotation of the motor 404 in the first rotational direction is stopped.

The separate roller 403 is supported on the second rotational axis 419 through a torque limiter 405, and the first feed roller 402 is connected to be interlocked with on the first rotational axis 417 through a one-way clutch 407. The paper P is acceleratedly fed with no interference by the separate roller 403 and the first feed roller 402 since the first feed roller 402 is driven by the paper P which is acceleratedly fed by the second feed roller 406 after the motor 404 is stopped.

Figure 4:
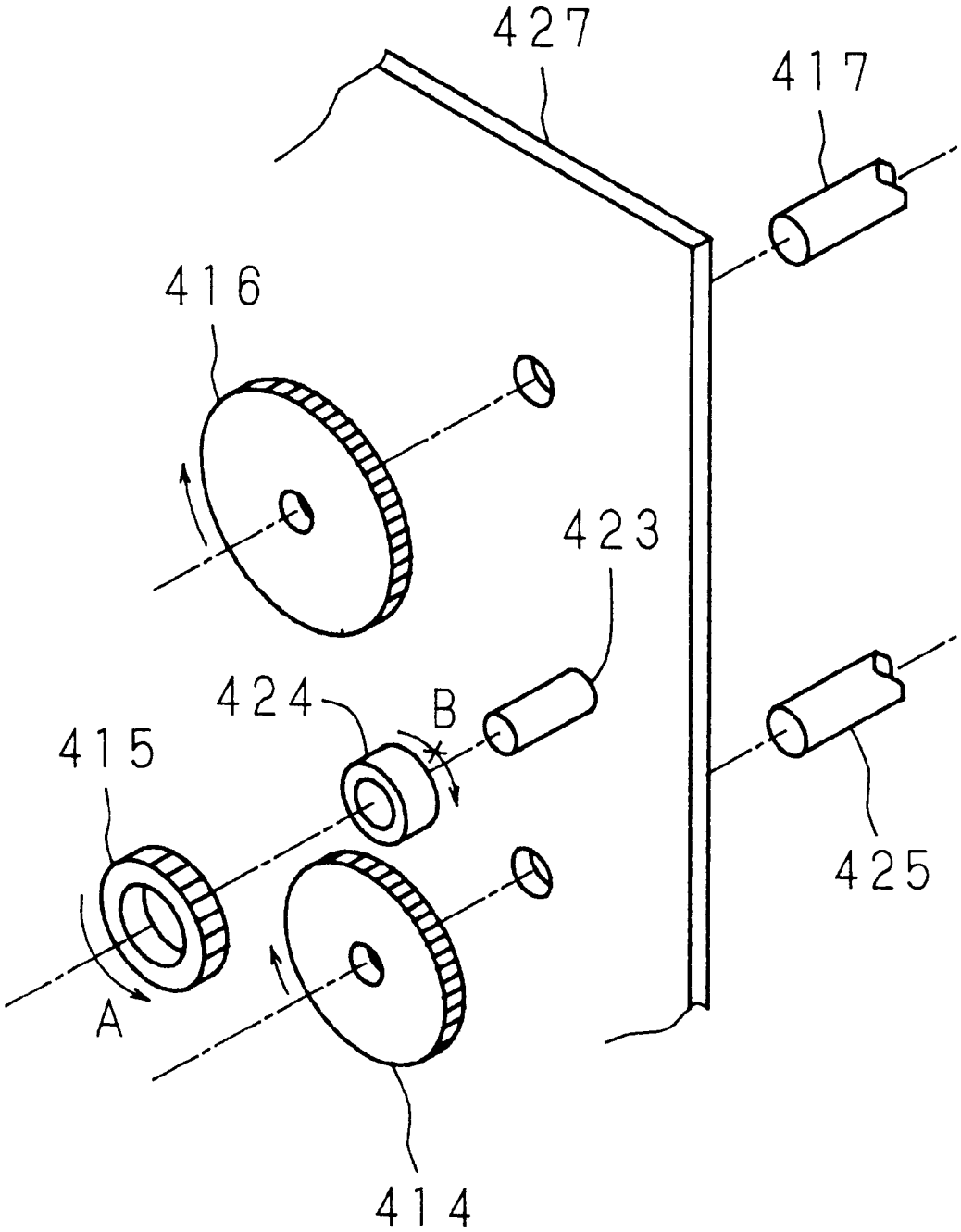
FIG. 4 is an exploded perspective view showing a key portion of one embodiment of the present invention.

FIG. 4 is an exploded perspective view showing a key portion of one embodiment of the present invention.

By the way in this paper feeding unit, as shown in FIG. 4, as a reverse-rotation preventing portion 424 which prevents the separate roller 403 from rotating in the reverse rotational direction together with the paper P which is fed by the second feed roller 406 when the motor 404 is stopped, a one-way clutch is interposed between the third idler gear 415 which interlocks the feed-roller driving gear 416 with the separate-roller driving gear 414 and a second fixed axis 423 which supports this third idler gear 415 allowing free rotation.

This reverse-rotation preventing portion (a one-way clutch) 424 allows the third idler gear 415 to rotate in the direction indicated by an arrow "A" direction while transmitting the rotation of the motor 404 from the separate-roller driving-gear 414 side to the feed-roller driving gear 416 side, and it allows the separate roller 403 which is interlocked with the third idler gear 415 through the separate-roller driving gear 414 and the first feed roller 402 to rotate in the same rotational direction. However, it prohibits the rotation of third idler gear 415 in the direction indicated by an arrow "B" and a "X".

Therefore, the rotation of the separate roller 403 in the direction opposite to that of the first feed roller 402 is prevented when the paper P is acceleratedly fed, wherein the separate roller 403 is interlocked with this third idler gear 415 through the separate-roller driving gear 414. As a result, the second and lower sheets of paper P fed back to the paper container 101 can not be re-fed into the gap between the first feed roller 402 and the separate roller 403 toward the second feed roller 406.

A reference number 425 in FIG. 3 and FIG. 4 designates a second rotational axis which has the separate-roller driving gear 414 fixed at the one end and is connected to be interlocked with the separate roller 403 through the torque limiter 405, a reference number 426 designates a frame, and a reference number 427 in FIG. 3 and FIG. 4 designates a sub-frame which is fixed on the frame 426 and supports said drive system 410.

Figure 5:
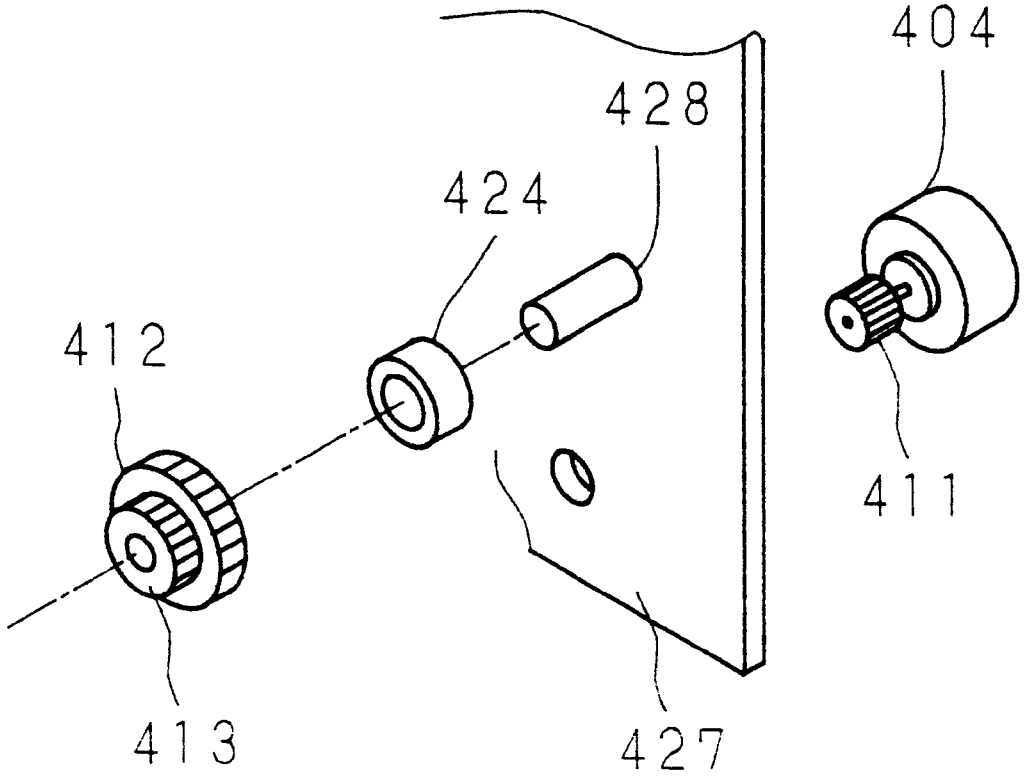
FIG. 5 is an exploded perspective view showing a key portion of another embodiment of the present invention.

FIG. 5 is an exploded perspective view showing a key portion of another embodiment of the present invention.

In FIG. 5, a reverse-rotation preventing portion 424 as a one-way clutch is interposed between the first idler gear 412 and a third fixed axis 428, instead of being interposed between the third idler gear 415 and the second fixed axis 423.

The remaining constitution of this embodiment is similar to that of the above-described electrophotographic device, and thus corresponding portions are indicated with the same reference numbers and explanations will be omitted.

In these two embodiments above, the reverse-rotation preventing portion 424 consisting of a one-way clutch is interposed between the second fixed axis 423 and the third idler gear 415, or between the third fixed axis 428 and the first idler gear 412. However, the same effects can be obtained by locating the reverse-rotation preventing portion 424 between the output axis of the motor 404, the first paper axis 417, or the second paper axis 425 and the sub-frame 427.

Figure 6:
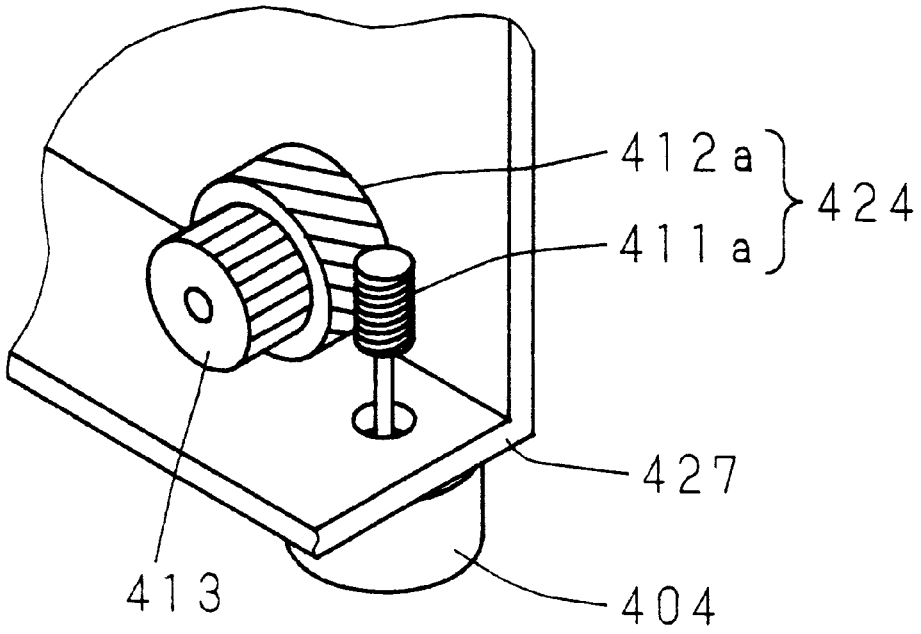
FIG. 6 is a perspective view showing a key portion of another embodiment of the present invention.

FIG. 6 is a perspective view showing a key portion of further embodiment of the present invention.

In FIG. 6, the output-axis gear 411 fixed on the output axis of the motor 404 consists of a worm gear 411*a,* and the first idler gear 412 mated with this output-axis gear 411 consists of a gear 412*a,* i.e. a worm wheel, mated with the worm gear 411*a,* Thus the reverse-rotation preventing portion 424 consists of the worm gear 411*a* and the gear 412*a* mated with the worm gear 411*a.*

However the gear 412*a* can be any gear which mates with the worm gear 411*a* being capable of non-reciprocal transmitting, and it could consist of, for example, a helical spur gear.

The remaining constitution of this embodiment is similar to that of the above-described electrophotographic device, and thus corresponding portions are indicated with the same reference numbers and detailed explanations will be omitted to avoid repetition.

Figure 7:
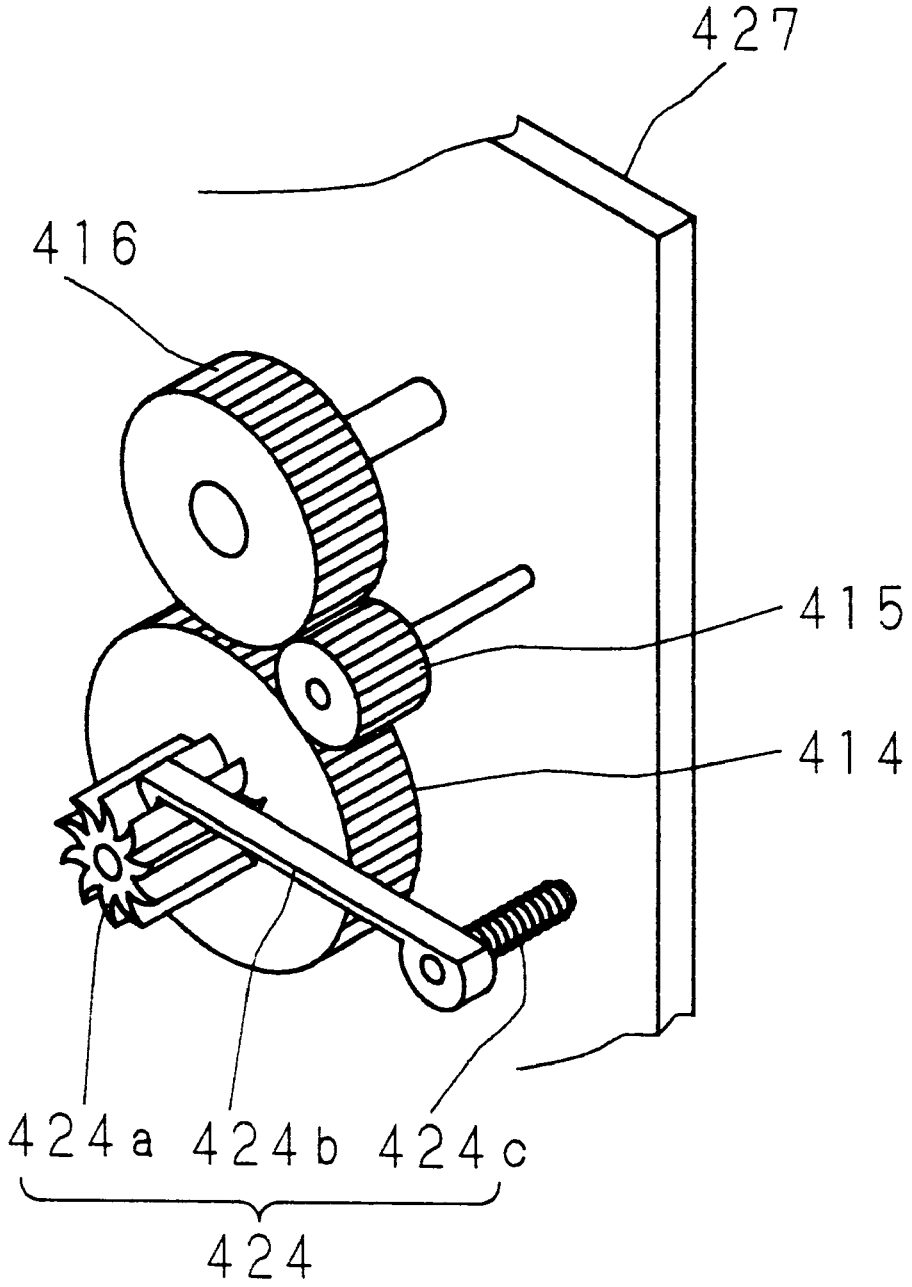
FIG. 7 is a perspective view showing a key portion of further embodiment of the present invention.

FIG. 7 is a perspective view showing still further embodiment of the present invention.

In FIG. 7, a ratchet gear 424*a* is fixed coaxially on the separate-roller driving gear 414 and a pawl 424*b* which engages/disengages to the ratchet gear 424*a* is supported allowing free rotation on the sub-frame 427. This pawl 424*b* is energized by a spring 424*c* in the direction to mate with the ratchet gear 424*a*. the reverse-rotation preventing portion 424 consists of the ratchet gear 424*a,* the pawl 424*b,* and the spring 424*c,* to prevent the separate roller 403 from reverse-rotating together with the paper P which is fed by the second feed roller 406, when the motor 404 is stopped.

The remaining constitution of this embodiment is similar to that of the above-described electrophotographic device, thus corresponding portions are indicated with the same reference numbers and detailed explanations will be omitted to avoid repetition.

The ratchet gear 424*a* can also be fixed coaxially on a gear other than the separate-roller driving gear 414 such as the output-axis gear 411, the first idler gear 412, the second idler gear 413, the third idler gear 415, or the feed-roller driving gear 416. Moreover, it can be fixed coaxially on a gear to be mated with any of the gears in the drive system 410.

The above is a description of the constitution to prevent from the reverse-rotation of the motor 404 by using mechanical means. This invention can also be realized by an electric motor control portion 430 as shown in FIG. 8.

Figure 8:
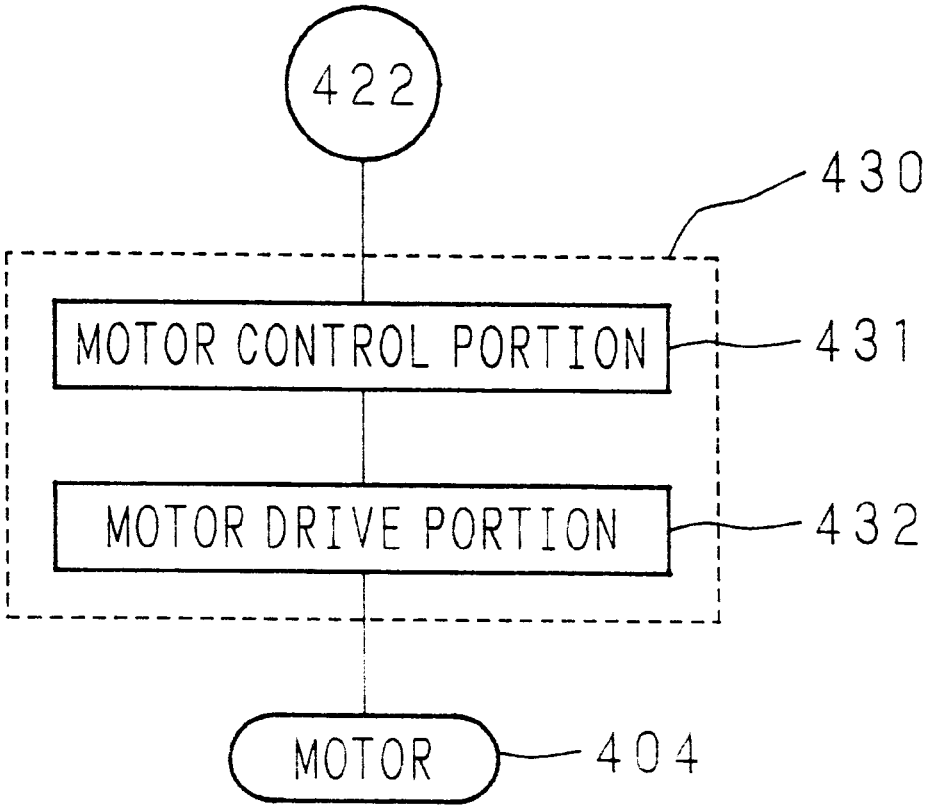
FIG. 8 is a functional block diagram showing still further embodiment of the present invention.

FIG. 8 is a functional block diagram showing still another embodiment of the present invention.

When a paper sensor 422 detects the front end of the paper P, the second motor described above is initiated and a motor control portion 431 controls a motor drive portion 432 at the same time, and the motor control portion 431 supplies each phase of the motor 404 with the holding current which is sufficient to stop the rotation of the motor 404 (for example, to prohibit the rotation of the phases if the motor 404 is a pulse motor). According to this, the aim of the present invention is accomplished without adding any specialized mechanical constituents.

In this embodiment, it is preferred to minimize temperature increase in the motor 404 by applying the holding current as pulse current.

As described above, according to the present invention wherein a reverse-rotation preventing portion is provided for preventing the separate roller from reverse-rotating together with the paper fed by the second feed roller when rotation of the motor which drives the separate roller in the first rotational direction is stopped, passing of more than one sheet of overlapped paper between the first feed roller and the separate roller can be firmly prevented.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An electric printing apparatus, comprising:

a paper container for containing paper;

a pick roller for picking said paper from said paper container;

a first feed roller for feeding said paper picked by said pick roller in order, said first feeder roller being driven in a first rotational direction;

a separate roller being pressed onto said first feed roller;

a motor for driving said separate roller in the same rotational direction as that of said first feed roller;

a drive system for interlocking said separate roller with said motor;

a torque limiter being interposed in said drive system;

a second feed roller for acceleratedly feeding paper which has passed through the gap between the first feed roller and the separate roller;

a printing portion for printing on said paper acceleratedly fed by said second feed roller, and a reverse rotation preventing portion for preventing said separate roller from rotating in a second rotational direction, which is opposed to that of said first feed roller, when rotation of said motor in the first rotational direction is stopped, wherein rotation of said motor in the first rotational direction is stopped after a front end of feeding paper has passed through the gap between the first feed roller and the separate roller, and when rotation of said motor in the first rotational direction is stopped, said reverse rotation preventing portion prevents said separate roller from rotating in said second rotational direction together with said paper acceleratedly fed by said second feed roller.

2. An electronic printing apparatus, according to claim 1, wherein said reverse-rotation preventing portion includes:

a current applying portion for applying holding current to said motor in said drive system to stop said motor.

3. An electronic printing apparatus, according to claim 1, wherein said reverse-rotation preventing portion is:

a motor control portion for supplying sufficient amount of current to said motor to stop the rotation of said motor.

4. A paper separating unit, comprising:

a pick roller for picking said paper from a paper container;

a first feed roller for feeding said paper picked by said pick roller in order, said first feeder roller being driven in a first rotational direction;

a separate roller being pressed onto said first feed roller;

a motor for driving said separate roller in the same rotational direction as that of said first feed roller;

a drive system for interlocking said separate roller with said motor;

a torque limiter being interposed in said drive system;

a second feed roller for acceleratedly feeding paper which has passed through the gap between the first feed roller and the separate roller;

a printing portion for printing on said paper acceleratedly fed by said second feed roller, and a reverse rotation preventing portion for preventing said separate roller from rotating in a second rotational direction, which is opposed to that of said first feed roller, when rotation of said motor in the first rotational direction is stopped, wherein rotation of said motor in the first rotational direction is stopped after a front end of feeding paper has passed through the gap between the first feed roller and the separate roller, and when rotation of said motor in the first rotational direction is stopped, said reverse rotation preventing portion prevents said separate roller from rotating in said second rotational direction together with said paper acceleratedly fed by said second feed roller.

5. A paper separating unit, according to claim 4, wherein said reverse-rotation preventing portion includes:

a current applying portion for applying holding current to said motor in said drive system to stop said motor.

6. A paper separating unit, according to claim 4, wherein said reverse-rotation preventing portion is:

a motor control portion for supplying sufficient amount of current so said motor to stop the rotation of said motor.

* * * * *